US011713216B2

(12) United States Patent
Chen

(10) Patent No.: US 11,713,216 B2
(45) Date of Patent: Aug. 1, 2023

(54) SAFETY EXIT ASSEMBLY FOR ELEVATOR CAR, AND ELEVATOR SYSTEM

(71) Applicant: Otis Elevator Company, Farmington, CT (US)

(72) Inventor: Zhuo Chen, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 39 days.

(21) Appl. No.: 17/388,732

(22) Filed: Jul. 29, 2021

(65) Prior Publication Data

US 2022/0135377 A1 May 5, 2022

(30) Foreign Application Priority Data

Nov. 2, 2020 (CN) ..... 202011201997.9

(51) Int. Cl.
*B66B 13/24* (2006.01)
*B66B 11/02* (2006.01)
*B66B 13/14* (2006.01)

(52) U.S. Cl.
CPC ..... *B66B 13/24* (2013.01); *B66B 11/0226* (2013.01); *B66B 13/143* (2013.01); *B66B 2201/306* (2013.01)

(58) Field of Classification Search
CPC ..... B66B 5/027; B66B 13/24; B66B 11/0226; B66B 11/0246; B66B 2201/306; B66B 11/0213; B66B 2009/006; B66B 5/0087
See application file for complete search history.

(56) References Cited

U.S. PATENT DOCUMENTS

| | | | | |
|---|---|---|---|---|
| 9,193,566 | B1 * | 11/2015 | Nieves | B66B 11/0226 |
| 10,294,074 | B2 * | 5/2019 | Olthuis | B66B 11/0407 |
| 10,662,032 | B2 * | 5/2020 | Hill | B66B 11/0246 |
| 2007/0056809 | A1 * | 3/2007 | Fernandes | B66B 11/0246 187/401 |

FOREIGN PATENT DOCUMENTS

| | | | | |
|---|---|---|---|---|
| CN | 106956984 | A * | 7/2017 | |
| CN | 109132764 | A * | 1/2019 | B66B 5/00 |
| CN | 210528199 | U * | 5/2020 | |
| EP | 3530603 | A1 * | 8/2019 | B66B 11/0226 |
| JP | 06115842 | A * | 4/1994 | |
| JP | 2012035922 | A * | 2/2012 | |
| KR | 20080063393 | A * | 7/2008 | |
| KR | 101894668 | B1 * | 10/2018 | |
| WO | WO-2018011457 | A1 * | 1/2018 | B66B 11/0246 |

* cited by examiner

*Primary Examiner* — Diem M Tran
(74) *Attorney, Agent, or Firm* — Cantor Colburn LLP

(57) ABSTRACT

A safety exit assembly for an elevator car and an elevator system. The safety exit assembly includes: a door panel, which is configured to open and close a safety exit of the elevator car, and which has an upper surface and a lower surface; a moving assembly, which includes a guide block provided on a lower surface of the door panel, and a guide rail which guides the door panel to move downward and translate through a cooperation with the guide block; a drive assembly, which drives the door panel to reciprocate along the guide rail; and a locking assembly, which includes an unlocking element provided on an upper surface of the door panel; wherein the unlocking element is electrically connected to the drive assembly, and an unlocking action of the unlocking element triggers the drive assembly to drive the door panel to move until the safety exit is opened.

18 Claims, 5 Drawing Sheets

SAFETY EXIT ASSEMBLY FOR ELEVATOR CAR, AND ELEVATOR SYSTEM

FOREIGN PRIORITY

This application claims priority to Chinese Patent Application No. 202011201997.9, filed Nov. 2, 2020, and all the benefits accruing therefrom under 35 U.S.C. § 119, the contents of which in its entirety are herein incorporated by reference

TECHNICAL FIELD

The present application relates to the field of elevators, and more specifically, the present application relates to a safety exit assembly for an elevator car of an elevator system.

BACKGROUND

As a tool for improving the walking of passengers between floors or shortening the walking distance of passengers, passenger transportation devices are very common in daily life. As an example, the most common passenger transportation devices are escalators and elevators that are usually used between floors of commercial buildings, and moving walkways that are usually used in large airports.

For an elevator system, it has an elevator car that usually runs in a dedicated hoistway, and has a relatively closed operating space. In order to avoid problems such as system failure during operation, a safety exit is usually provided on a top of the elevator car to provide an escape passage in case of emergency. For a type of elevator system, it may have two or more elevator cars that do not interfere with each other in the same hoistway. In this case, a safety exit may be further provided at a bottom of one of the elevator cars which is positioned higher. As to this type of bottom safety exit, it is used as both a safety exit and a part of a car floor to provide foot support for passengers under daily conditions, and it is opened in case of emergency so that passengers can enter the hoistway to escape. As a tool for improving the walking of passengers between floors or shortening the walking distance of passengers, passenger transportation devices are very common in daily life. As an example, the most common passenger transportation devices are escalators and elevators that are usually used between floors of commercial buildings, and moving walkways that are usually used in large airports.

For an elevator system, it has an elevator car that usually runs in a dedicated hoistway, and has a relatively closed operating space. In order to avoid problems such as system failure during operation, a safety exit is usually provided on a top of the elevator car to provide an escape passage in case of emergency. For a type of elevator system, it may have two or more elevator cars that do not interfere with each other in the same hoistway. In this case, a safety exit may be further provided at a bottom of one of the elevator cars which is positioned higher. As to this type of bottom safety exit, it is used as both a safety exit and a part of a car floor to provide foot support for passengers under daily conditions, and it is opened in case of emergency so that passengers can enter the hoistway to escape.

SUMMARY

The present application aims to provide an improved safety exit assembly for an elevator car, and an elevator system, so as to efficiently and reliably realize opening and closing of a safety exit.

In order to achieve at least one object of the present application, according to an aspect of the present application, a safety exit assembly for an elevator car is provided, which includes: a door panel, which is configured to open and close a safety exit of the elevator car, and which has an upper surface and a lower surface; a moving assembly, which includes a guide block provided on a lower surface of the door panel, and a guide rail which guides the door panel to move downward and translate through a cooperation with the guide block; a drive assembly, which drives the door panel to reciprocate along the guide rail, in a controlled manner; and a locking assembly, which includes an unlocking element provided on an upper surface of the door panel; wherein the unlocking element is electrically connected to the drive assembly, and an unlocking action of the unlocking element triggers the drive assembly to drive the door panel to move until the safety exit is opened.

In addition to or instead of one or more of the above features, in another embodiment, the safety exit assembly further includes a limit switch, which is configured to sense an end point of the movement of the door panel along the guide rail and which is electrically connected to the drive assembly, and a sensing signal of the limit switch triggers the drive assembly to stop driving the door panel.

In addition to or instead of one or more of the above features, in another embodiment, the safety exit assembly further includes a reset switch, which is electrically connected to the drive assembly, and a reset action of the reset switch triggers the drive assembly to drive the door panel to move until the safety exit is closed.

In addition to or instead of one or more of the above features, in another embodiment, the locking assembly further includes a safety switch which is provided between the lower surface of the door panel and the guide rail and which is associated with the unlocking element; wherein the unlocking action of the unlocking element drives the safety switch to be turned off, thereby triggering the elevator car to stop moving.

In addition to or instead of one or more of the above features, in another embodiment, the safety switch includes a switch contact provided on the lower surface of the door panel and a switch body provided on the guide rail.

In addition to or instead of one or more of the above features, in another embodiment, the locking assembly further includes a stop element which is provided on the lower surface of the door panel, and which is associated with the unlocking element; wherein the stop element has a stop state in which the door panel is prevented from moving, and a movable state in which the door panel is allowed to move, and the unlocking action of the unlocking element drives the stop element to convert from the stop state to the movable state.

In addition to or instead of one or more of the above features, in another embodiment, the stop element includes: a stop insert associated with the unlocking element, and a stop notch disposed on the guide rail; wherein in the stop state, the stop insert is inserted into the stop notch, and in the movable state, the stop insert moves out of the stop notch.

In addition to or instead of one or more of the above features, in another embodiment, the stop element and the safety switch are integrated into a single piece, and are simultaneously associated with the unlocking element.

In addition to or instead of one or more of the above features, in another embodiment, the guide rail includes a first section and a second section; wherein the first section guides the door panel to move to a first height lower than the safety exit, and the second section guides the door panel to move in a horizontal direction while maintaining the first height.

In addition to or instead of one or more of the above features, in another embodiment, the drive assembly includes an electric push rod, a pneumatic push rod or a hydraulic push rod.

In order to achieve at least one object of the present application, according to another aspect of the present application, an elevator system is further provided, which includes: a plurality of elevator cars, one of which positioned relatively higher has a floor provided with a safety exit; and a safety exit assembly which has: a door panel which is provided at the safety exit and is configured to open and close the safety exit, wherein the door panel has an upper surface and a lower surface, and the upper surface of the door panel is flush with the floor; a moving assembly, which includes a guide block provided on the lower surface of the door panel, and a guide rail which is provided at a bottom of the floor and which guides the door panel to move downward and translate relative to the floor through a cooperation with the guide block; a drive assembly, which is installed at the bottom of the floor and which drives the door panel to reciprocate along the guide rail in a controlled manner; and a locking assembly, which includes an unlocking element provided on the upper surface of the door panel; wherein the unlocking element is electrically connected to the drive assembly, and an unlocking action of the unlocking element triggers the drive assembly to drive the door panel to move until the safety exit is opened.

In addition to or instead of one or more of the above features, in another embodiment, the safety exit assembly further includes a limit switch electrically connected to the drive assembly, and the limit switch includes a switch body installed at the bottom of the floor and a switch contact installed at the lower surface of the door panel; wherein when the door panel reaches an end point of its movement along the guide rail, the switch contact of the limit switch is engaged with the switch body, and the drive assembly is triggered to stop driving the door panel.

In addition to or instead of one or more of the above features, in another embodiment, the safety exit assembly further includes a reset switch which is installed at the bottom of the floor and is electrically connected to the drive assembly, wherein a reset action of the reset switch triggers the drive assembly to drive the door panel to move until the safety exit is closed.

In addition to or instead of one or more of the above features, in another embodiment, the locking assembly further includes a safety switch which is provided between the lower surface of the door panel and the guide rail and which is associated with the unlocking element; wherein the unlocking action of the unlocking element drives the safety switch to be turned off, thereby triggering the elevator car to stop moving.

In addition to or instead of one or more of the above features, in another embodiment, the safety switch includes a switch contact provided on the lower surface of the door panel and a switch body provided on the guide rail.

In addition to or instead of one or more of the above features, in another embodiment, the locking assembly further includes a stop element which is provided on the lower surface of the door panel, and which is associated with the unlocking element; wherein the stop element has a stop state in which the door panel is prevented from moving, and a movable state in which the door panel is allowed to move, and the unlocking action of the unlocking element drives the stop element to convert from the stop state to the movable state.

In addition to or instead of one or more of the above features, in another embodiment, the stop element further includes: a stop insert associated with the unlocking element, and a stop notch disposed on the guide rail; wherein in the stop state, the stop insert is inserted into the stop notch, and in the movable state, the stop insert moves out of the stop notch.

In addition to or instead of one or more of the above features, in another embodiment, the stop element and the safety switch are integrated into a single piece, and are simultaneously associated with the unlocking element.

According to the safety exit assembly for an elevator car and the elevator system of the present application, the door panel moves downward and translates relative to the safety exit provided on the floor of the elevator car with the aid of the moving assembly, thereby enabling the door panel to kept flush with the floor of the elevator car in the closed state, which prevent passengers from being tripped; whereas in the open state, the safety exit can be fully opened to facilitate the escape of passengers; through the cooperation of the drive assembly and the locking assembly, the door panel at the safety exit can be reliably locked and driven to ensure its stability under normal conditions, thereby reducing vibration and noise; and quick opening in case of emergency can be realized.

BRIEF DESCRIPTION OF THE DRAWINGS

FIG. 4 is an enlarged schematic view of an embodiment of a safety switch of the elevator system, in which the safety switch is turned on.

DETAILED DESCRIPTION

Hereinafter, the present application will be described in detail with reference to exemplary embodiments in the accompanying drawings. However, it should be understood that the present application can be implemented in many different forms, and should not be construed as being limited to the embodiments set forth herein. These embodiments are provided herein to make the disclosure of the present application more complete and similar, and to fully convey the concept of the present application to those skilled in the art.

In addition, for any single technical feature described or implied in the embodiments mentioned herein, or any single technical feature shown or implied in individual drawings, the present application still allows these technical features (or equivalents thereof) to be further arbitrarily combined or added or deleted without any technical obstacle, thereby obtaining more other embodiments of the present application that may not have been directly mentioned herein.

In the present application, a safety exit assembly 100 that has been installed on a floor of an elevator car of an elevator system, and its arrangement associated with the elevator car will be exemplarily described with reference to FIGS. 1-10. However, it should be understood that the safety exit assembly and other parts of the elevator car provided according to the present application may be designed, manufactured and sold separately, or they may be assembled together and then sold as a whole. Either the single pieces formed before the combination or the entirety formed after the combination will fall into the scope of protection of the present application.

Figure 1:
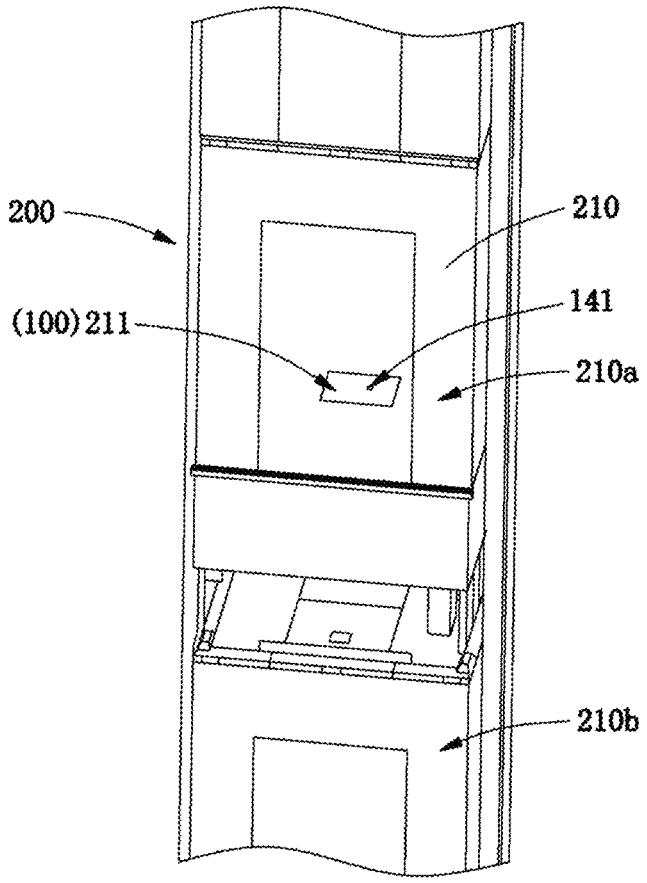
FIG. 1 is a schematic perspective view of an embodiment of an elevator system, in which a closed safety exit at a bottom of an elevator car is shown.
Figure 2:
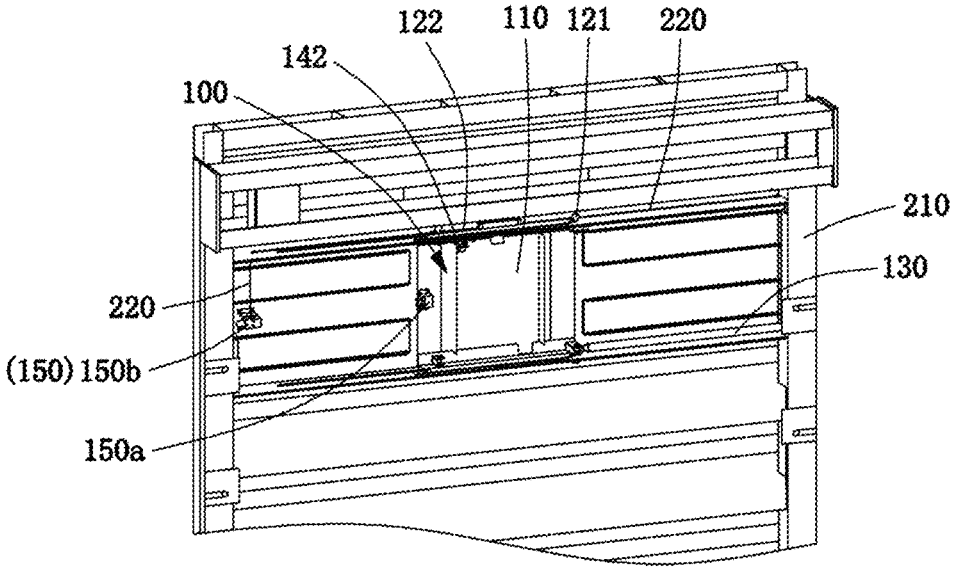
FIG. 2 is a schematic perspective view of the bottom of the elevator car of an embodiment of the elevator system, in which the safety exit is closed.

Referring to the drawings, an elevator system 200 shown in FIG. 1 includes an elevator car group 210 located in a hoistway, which includes an upper elevator car 210*a* and a lower elevator car 210*b* both vertically arranged in the hoistway, and more possible cars (not shown) connected in series. A safety exit 211 may be provided on a floor of the elevator car 210*a* located at a relatively higher position, and the safety exit has been closed by a safety exit assembly 100. After the safety exit assembly 100 closes the safety exit, an upper surface of a door panel of the safety exit assembly 100 is flush with the floor of the car. Therefore, in a normal operating state of the elevator system, the safety exit assembly 100 will be basically integrated with the floor of the car, which provides passengers with sufficient support from the floor, and which will not cause the problem of stumbling when passengers enter and exit the elevator car.

Various components and functions of the safety exit assembly 100 will be described in detail below with reference to FIGS. 2-9. The safety exit assembly 100 includes a door panel 110 for opening and closing the safety exit 211. The door panel 110 has an upper surface and a lower surface, and has a contour that matches the safety exit 211, such as a rectangular shape. As briefly mentioned above, in an assembled state, the upper surface of the door panel 110 is flush with the floor of the car. It can be seen from FIG. 2 that, in order to avoid interference or influence on passengers in the car, most of the components of the safety exit assembly 100 are installed on a bottom side of the floor of the car. For example, the safety exit assembly 100 also includes a moving assembly, which has a guide block 121 provided on the lower surface of the door panel 110 and a guide rail 122 provided on the bottom of the floor. Through a cooperation with the guide block 121, the guide rail 122 guides the door panel 110 fixedly connected or integrally formed with the guide block 121 to move downward and translate relative to the floor. It should be understood that, considering that the upper surface of the door panel 110 remains flush with the floor of the car, when the door panel is opened in case of emergency, an action of directly translating the door panel away will be hindered by the floor of the car. Therefore, by first moving the door panel downward relative to the floor, the two can be staggered in the horizontal direction, thereby ensuring that the subsequent translating movement of the door panel will not be hindered. As a specific example, the guide rail 122 may correspondingly include a first section 122*a* and a second section 122*b*; wherein the first section 122*a* guides the door panel 110 to move to a first height lower than the safety exit, and the second section 122*b* guides the door panel 110 to move in the horizontal direction while maintaining the first height.

In addition, the safety exit assembly 100 further includes a drive assembly 130, which is installed at the bottom of the floor and can drive the door panel to reciprocate along the guide rail 122 in a controlled manner. As a result, the door panel 110 of the safety exit assembly 100 is automatically and smoothly driven. In addition, when the safety exit assembly 100 is not opened, the drive assembly 130 may also reliably abut the door panel against the safety exit fixed on the floor of the car, so as to realize close engagement between the two and avoid vibration and noise. As a specific example, the drive assembly 130 may include an electric push rod, a pneumatic push rod or a hydraulic push rod.

Furthermore, the safety exit assembly 100 further includes a locking assembly to perform a function of locking and unlocking the door panel 110. First, the locking assembly should include an unlocking element 141 provided on the upper surface of the door panel 110, and the unlocking element 141 is electrically connected to the drive assembly 130 so that operations of the two are related. For example, in case of emergency, a passenger performs an unlocking action by operating the unlocking element 141, which can trigger the drive assembly 130 due to the association so as to drive the door panel 110 to move until the safety exit is opened. As a specific example, a common triangular lock and key structure may be adopted for the unlocking element 141.

The safety exit assembly for the elevator car under this arrangement can remain flush with the floor of the elevator car in the closed state to prevent passengers from being tripped, and in the open state, the safety exit can be fully opened to facilitate the escape of passengers; moreover, reliable locking and driving of the door panel at the safety exit can be realized to ensure its stability under normal conditions, thereby reducing vibration and noise; and quick opening in case of emergency can be realized.

Figure 3:
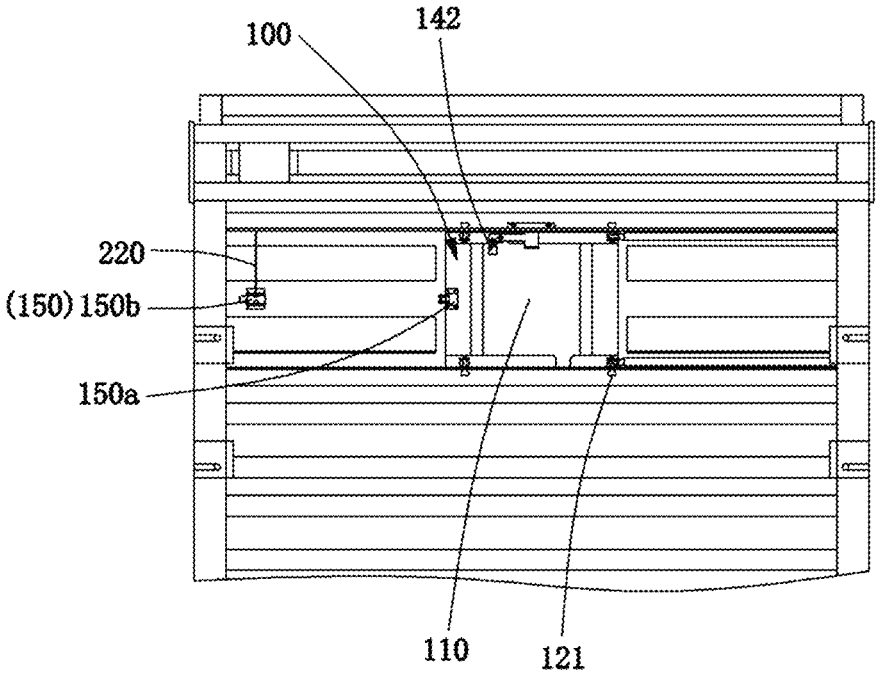
FIG. 3 is a schematic bottom view of the bottom of the elevator car of an embodiment of the elevator system, in which the safety exit is closed.
Figure 7:
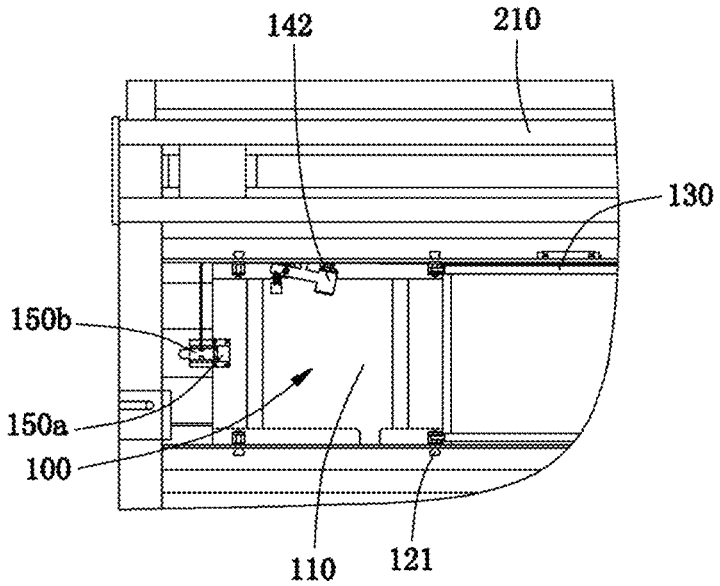
FIG. 7 is a schematic bottom view of the bottom of the elevator car of an embodiment of the elevator system, in which the safety exit is opened.
Figure 8:
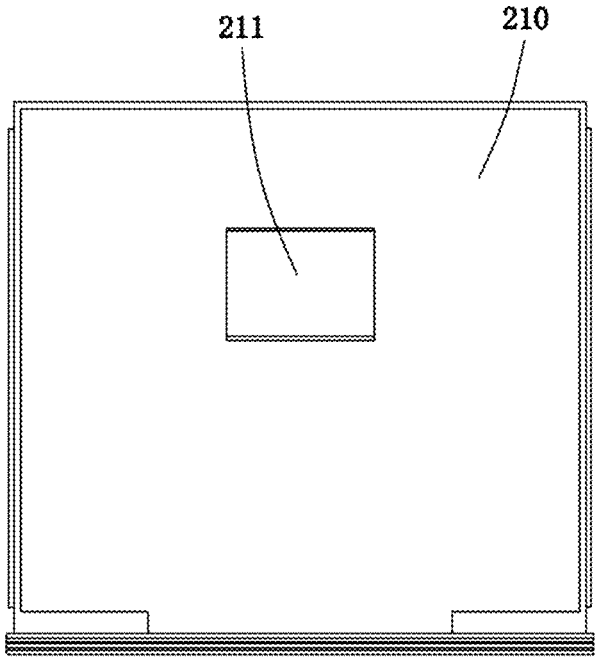
FIG. 8 is a schematic top view of the bottom of the elevator car of an embodiment of the elevator system, in which the safety exit is opened.

The following description will continue to introduce configurations of various components of the safety exit assembly. In addition, in order to further improve the reliability and comfort or in consideration of improvements in other aspects, some additional parts may be added, as will also be exemplified below For example, as shown in FIGS. 3 and 7, the safety exit assembly 100 may further include a limit switch 150 electrically connected to the drive assembly, and the limit switch 150 includes a switch body 150*b* installed at the bottom of the car floor and a switch contact 150*a* installed at the lower surface of the door panel 110; wherein when the door panel 110 reaches an end point of its movement along the guide rail 122, the switch contact 150*a* of the limit switch 150 is engaged with the switch body 150*b*, and the drive assembly 130 is triggered to stop driving the door panel 110. This arrangement provides the end point of movement of the door panel 110 and the drive assembly 130, so that the entire driving control forms a closed loop.

Figure 9:
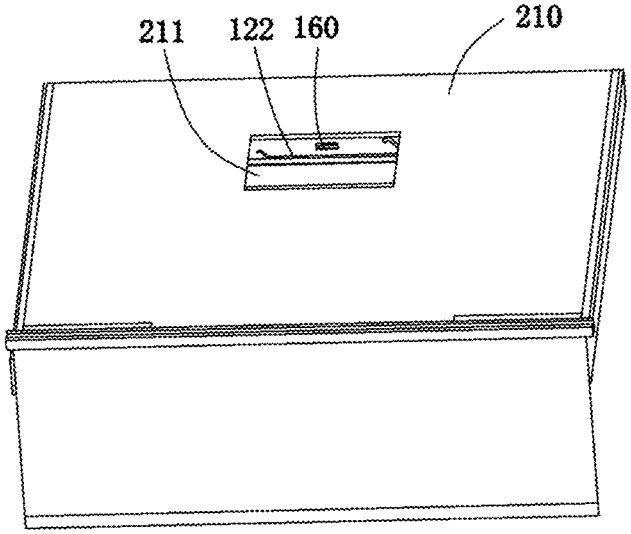
FIG. 9 is a schematic perspective view of the bottom of the elevator car of an embodiment of the elevator system, in which the safety exit is opened.
Figure 10:
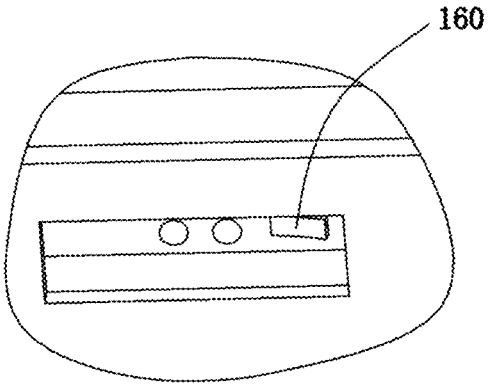
FIG. 10 is an enlarged schematic view of an embodiment of a reset switch of the elevator system.

Furthermore, referring to FIGS. 9 and 10, the safety exit assembly 100 further includes a reset switch 160 which is installed at the bottom of the car floor and which is electrically connected to the drive assembly 130. After the passengers escape from the car through the safety exit, in order to avoid the problem of someone entering the car by mistake and falling from the safety exit under other conditions, a reset function can also be performed by operating the reset switch 160 provided at the bottom. For example, a reset action of the reset switch 160 in the form of a button triggers the drive assembly 130 to drive the door panel 110 to move until the safety exit is closed.

Figure 4:
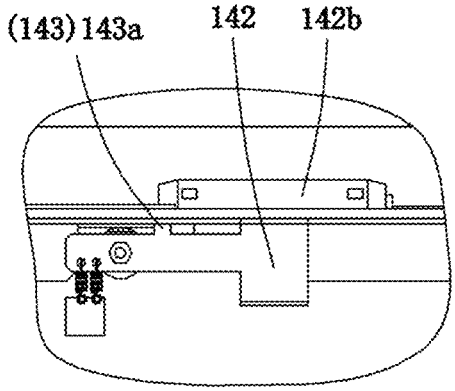
Figure 5:
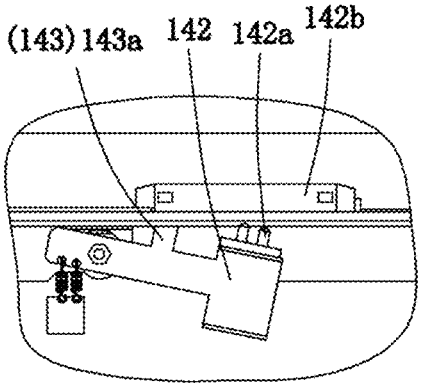
FIG. 5 is a schematic view of the embodiment of the safety switch in FIG. 4, in which the safety switch is turned off.

In addition, referring to FIGS. 3 to 5, the locking assembly described in the above embodiment may additionally include a safety switch 142 provided between the lower surface of the door panel 110 and the guide rail 122. Specifically, the safety switch 142 includes a switch contact 142*a* provided on the lower surface of the door panel 110 and a switch body 142*b* provided on the guide rail 122. The safety switch 142 can be used to terminate the movement of the elevator car and is associated with the unlocking element 141. In case of emergency, as the passenger operates the unlocking element 141 to perform the unlocking action, the associated safety switch 142 is also disconnected, which in turn triggers the elevator car to stop moving to avoid danger.

Figure 6:
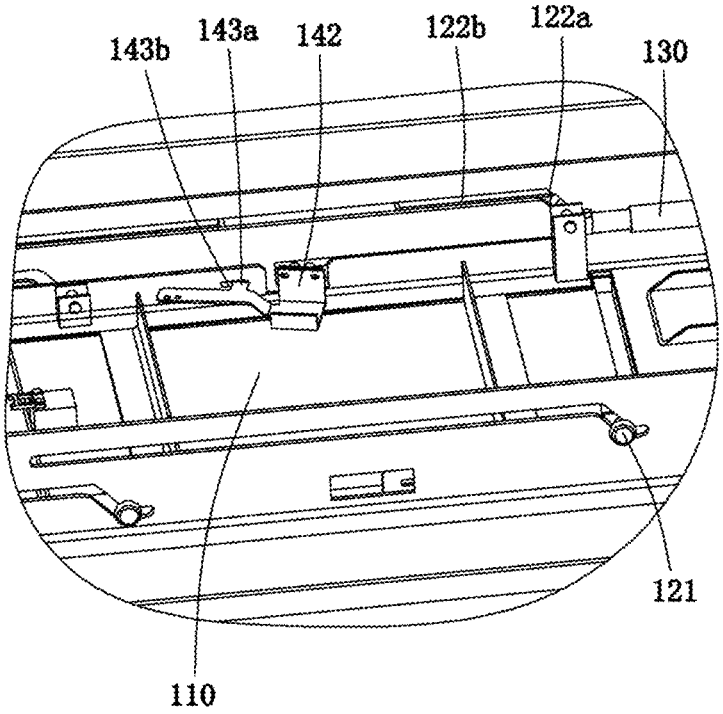
FIG. 6 is a detailed schematic view of a moving assembly of an embodiment of the elevator system.

Turning to FIGS. 4 to 6, the locking assembly described in the above embodiment may additionally include a stop element 143 which is provided on the lower surface of the door panel 110 and which is associated with unlocking element 141. The stop element 143 has a stop state in which the door panel 110 is prevented from moving, and a movable state in which the door panel 110 is allowed to move, and the unlocking action of the unlocking element 141 drives the stop element 143 to convert from the stop state to the movable state. Therefore, this provides a further mechanical guarantee for the reliability of the safety exit assembly, so that the door panel in a normal state is further locked by the stop element 143 to avoid accidental opening of the door panel due to phenomena such as vibration.

Specifically, the stop element 143 mentioned above may include a stop insert 143*a* associated with the unlock element 141, and a stop notch 143*b* provided on the guide rail 122. In the stop state, the stop insert 143*a* is inserted into the stop notch 143*b*, thereby realizing the mechanical locking of the downward movement and translational movement of the door panel; and in the movable state, the stop insert 143*a* moves out of the stop notch 143*b*, thereby realizing the mechanical unlocking of the downward movement and translational movement of the door panel.

More specifically, as an example, the stop element 143 and the safety switch 142 may be integrated into a single piece, and are simultaneously associated with the unlocking element 141, thereby realizing associated operations and control of multiple components and making the entire operation process simpler and more convenient.

A series of escape operations in an emergency state of an elevator system in which the safety exit assembly of an embodiment of the present application is applied will be described below with reference to FIGS. 1 to 10. First, referring to FIG. 1, when a passenger is in the elevator car 210 and an emergency occurs, the passenger can operate the unlocking element 141 on the door panel 110 by actions such as screwing. At this point, referring to FIGS. 2 to 6, the associated safety switch 142 and the stop element 143 both rotate accordingly, so that the switch contact 142*a* of the safety switch 142 that is located on the door panel is disconnected from the switch body 142*b* on the guide rail, causing the elevator car to stop running; at the same time, the stop insert 1423*a* of the stop element 143 that is located on the door panel is disconnected from the stop notch 143*b* on the guide rail, thereby unlocking the mechanical locking of the door panel relative to the guide rail. Subsequently, driven by the drive assembly 130, the door panel 110 can move relative to the guide rail 122 through the guide block 121. Specifically, the door panel 110 moves downward relative to the first section 122*a* of the guide rail 122, and then translates relative to the second section 122*b* of the guide rail 122. Continuing to refer to FIGS. 7 to 8, as the door panel 110 moves, when it reaches the allowable end point of movement, the switch contact 150*a* of the limit switch 150 that is located on the door panel 110 will engage with the switch body 150*b* of the limit switch 150 that is located on the bottom side of the car floor, thereby sending a signal to terminate the action of the drive assembly 130 and further stop the movement of the door panel 110. At this point, the entire opening process of the safety exit has been completed, and passengers can escape from the bottom of the car via the safety exit. Referring to FIGS. 9 to 10, after the passengers have escaped, by operating the reset switch 160 at the bottom of the car, the door panel 110 is moved in a reverse direction to close the safety exit 211 again, thereby completing the closing process of the safety exit.

In the above examples, the safety exit assembly for an elevator car and the elevator system of the present application are mainly described. Although only some of the embodiments of the present application have been described, those skilled in the art should understand that the present application may be implemented in many other forms without departing from the spirit and scope thereof. Therefore, the illustrated examples and embodiments should be regarded as illustrative rather than restrictive, and the present application may cover various modifications and replacements without departing from the spirit and scope of the present application as defined by the appended claims.

What is claimed is:

1. A safety exit assembly for an elevator car, comprising:

a door panel, which is configured to open and close a safety exit of the elevator car, and which has an upper surface and a lower surface, the upper surface of the door panel configured to be flush with a floor of the elevator car;

a moving assembly, which comprises a guide block provided on a lower surface of the door panel, and a guide rail which guides the door panel to move downward and translate through a cooperation with the guide block;

a drive assembly, which drives the door panel to reciprocate along the guide rail, in a controlled manner; and a locking assembly, which comprises an unlocking element provided on an upper surface of the door panel; wherein the unlocking element is electrically connected to the drive assembly, and an unlocking action of the unlocking element triggers the drive assembly to drive the door panel to move until the safety exit is opened.

2. The safety exit assembly according to claim 1, further comprising a limit switch, which is configured to sense an end point of the movement of the door panel along the guide rail and which is electrically connected to the drive assembly, and a sensing signal of the limit switch triggers the drive assembly to stop driving the door panel.

3. The safety exit assembly according to claim 1, further comprising a reset switch, which is electrically connected to the drive assembly, and a reset action of the reset switch triggers the drive assembly to drive the door panel to move until the safety exit is closed.

4. The safety exit assembly according to claim 1, wherein the locking assembly further comprises a safety switch which is provided between the lower surface of the door panel and the guide rail and which is associated with the unlocking element; and wherein the unlocking action of the unlocking element drives the safety switch to be turned off, thereby triggering the elevator car to stop moving.

5. The safety exit assembly according to claim 4, wherein the safety switch comprises a switch contact provided on the lower surface of the door panel and a switch body provided on the guide rail.

6. The safety exit assembly according to claim 4, wherein the locking assembly further comprises a stop element which is provided on the lower surface of the door panel, and which is associated with the unlocking element; and wherein the stop element has a stop state in which the door panel is prevented from moving, and a movable state in which the door panel is allowed to move, and the unlocking action of the unlocking element drives the stop element to convert from the stop state to the movable state.

7. The safety exit assembly according to claim 6, wherein the stop element comprises: a stop insert associated with the unlocking element, and a stop notch disposed on the guide rail; and wherein in the stop state, the stop insert is inserted into the stop notch, and in the movable state, the stop insert moves out of the stop notch.

8. The safety exit assembly according to claim 6, wherein the stop element and the safety switch are integrated into a single piece, and are simultaneously associated with the unlocking element.

9. The safety exit assembly according to claim 1, wherein the guide rail comprises a first section and a second section, the first section guides the door panel to move to a first height lower than the safety exit, and the second section guides the door panel to move in a horizontal direction while maintaining the first height.

10. The safety exit assembly according to claim 1, wherein the drive assembly comprises an electric push rod, a pneumatic push rod or a hydraulic push rod.

11. An elevator system, comprising:

a plurality of elevator cars, one of which positioned relatively higher has a floor provided with a safety exit; and a safety exit assembly having:

a door panel which is provided at the safety exit and is configured to open and close the safety exit, the door panel having an upper surface and a lower surface, and the upper surface of the door panel being flush with the floor;

a moving assembly, which comprises a guide block provided on the lower surface of the door panel, and a guide rail which is provided at a bottom of the floor and which guides the door panel to move downward and translate relative to the floor through a cooperation with the guide block;

a drive assembly, which is installed at the bottom of the floor and which drives the door panel to reciprocate along the guide rail in a controlled manner; and a locking assembly, which comprises an unlocking element provided on the upper surface of the door panel; wherein the unlocking element is electrically connected to the drive assembly, and an unlocking action of the unlocking element triggers the drive assembly to drive the door panel to move until the safety exit is opened.

12. The elevator system according to claim 11, wherein the safety exit assembly further comprises a limit switch electrically connected to the drive assembly, and the limit switch comprises a switch body installed at the bottom of the floor and a switch contact installed at the lower surface of the door panel; and wherein when the door panel reaches an end point of its movement along the guide rail, the switch contact of the limit switch is engaged with the switch body, and the drive assembly is triggered to stop driving the door panel.

13. The elevator system according to claim 11, wherein the safety exit assembly further comprises a reset switch which is installed at the bottom of the floor and is electrically connected to the drive assembly, and a reset action of the reset switch triggers the drive assembly to drive the door panel to move until the safety exit is closed.

14. The elevator system according to claim 11, wherein the locking assembly further comprises a safety switch which is provided between the lower surface of the door panel and the guide rail and which is associated with the unlocking element; and wherein the unlocking action of the unlocking element drives the safety switch to be turned off, thereby triggering the elevator car to stop moving.

15. The elevator system according to claim 14, wherein the safety switch comprises a switch contact provided on the lower surface of the door panel and a switch body provided on the guide rail.

16. The elevator system according to claim 14, wherein the locking assembly further comprises a stop element which is provided on the lower surface of the door panel, and which is associated with the unlocking element; and wherein the stop element has a stop state in which the door panel is prevented from moving, and a movable state in which the door panel is allowed to move, and the unlocking action of the unlocking element drives the stop element to convert from the stop state to the movable state.

17. The elevator system according to claim 16, wherein the stop element further comprises: a stop insert associated with the unlocking element, and a stop notch disposed on the guide rail; and wherein in the stop state, the stop insert is inserted into the stop notch, and in the movable state, the stop insert moves out of the stop notch.

18. The elevator system according to claim 16, wherein the stop element and the safety switch are integrated into a single piece, and are simultaneously associated with the unlocking element.

* * * * *